US010105027B2

(12) United States Patent
Walker

(10) Patent No.: US 10,105,027 B2
(45) Date of Patent: Oct. 23, 2018

(54) CLEANING DEVICE

(71) Applicant: BLACK & DECKER INC., New Britain, CT (US)

(72) Inventor: Andrew Walker, Durham (GB)

(73) Assignee: BLACK & DECKER INC., New Britain, CT (US)

( * ) Notice: Subject to any disclaimer, the term of this patent is extended or adjusted under 35 U.S.C. 154(b) by 0 days.

(21) Appl. No.: 15/805,604

(22) Filed: Nov. 7, 2017

(65) Prior Publication Data

US 2018/0132683 A1 May 17, 2018

(30) Foreign Application Priority Data

Nov. 15, 2016 (EP) ..... 16198817

(51) Int. Cl.

| | |
|---|---|
| ***A47L 5/24*** | (2006.01) |
| ***A47L 9/02*** | (2006.01) |
| ***A47L 5/36*** | (2006.01) |
| ***A47L 9/24*** | (2006.01) |
| ***A47L 9/14*** | (2006.01) |
| ***A47L 9/12*** | (2006.01) |
| ***A47L 9/32*** | (2006.01) |
| ***A47L 9/16*** | (2006.01) |

(52) U.S. Cl.

CPC ..... *A47L 9/02* (2013.01); *A47L 5/24* (2013.01); *A47L 5/36* (2013.01); *A47L 9/12* (2013.01); *A47L 9/149* (2013.01); *A47L 9/1683* (2013.01); *A47L 9/248* (2013.01); *A47L 9/322* (2013.01)

(58) Field of Classification Search

CPC ... A47L 5/24; A47L 5/36; A47L 9/248; A47L 9/322

See application file for complete search history.

(56) References Cited

U.S. PATENT DOCUMENTS

| | | | |
|---|---|---|---|
| 5,787,546 | A | 8/1998 | Bass et al. |
| 2005/0273969 | A1 | 12/2005 | Watson |

FOREIGN PATENT DOCUMENTS

| | | |
|---|---|---|
| DE | 102011055668 | 5/2013 |
| EP | 1752076 | 2/2007 |
| EP | 2223644 | 9/2010 |

OTHER PUBLICATIONS

EP Search Report dated May 9, 2017 relating to EP Application No. 16198817.

*Primary Examiner* — David Redding
(74) *Attorney, Agent, or Firm* — John Yun

(57) ABSTRACT

A vacuum cleaner comprises a housing; a motor fan assembly mounted in the housing; a pivotable inlet nozzle in fluid communication with the motor fan assembly; and a dirt container coupled to the pivotable inlet nozzle and the housing. The pivotable inlet nozzle is pivotable a first operable position whereby the pivotable inlet nozzle is in fluid communication with a flexible hose mounted on the housing and a second operable position whereby the pivotable inlet nozzle projects from the housing and is remote from the flexible hose.

16 Claims, 9 Drawing Sheets

CLEANING DEVICE

CROSS-REFERENCE TO RELATED APPLICATION

This application claims priority to European Patent Application No. 16198817.5 filed Nov. 15, 2016. The entire contents of that application are expressly incorporated herein by reference.

FIELD OF THE INVENTION

The present invention relates to a vacuum cleaner. In particular the present invention relates to a vacuum cleaner with a moveable nozzle.

BACKGROUND OF THE INVENTION

Vacuum cleaners are used to collect dirt and debris from surfaces. Handheld vacuum cleaners can be held by the user to clean surfaces above the floor. When cleaning high surfaces, the user may have difficultly using a handheld vacuum cleaner without standing on steps or a chair.

It is known to provide a handheld vacuum cleaner with a moveable nozzle. Two such vacuum cleaners are shown in both EP 1 752 076 and EP 2 223 644. These vacuum cleaners have nozzles that are pivotable between different positions. This makes reaching high surfaces or accessing low surfaces easier.

A problem with the handheld vacuum cleaners is that the pivotable nozzle is bulky and cannot always fit into small spaces. The user may be required to attach accessories for specific cleaning applications. However the user may have to store the cleaning accessories separately and this is inconvenient for the user or the user may forget about them entirely.

Another vacuum cleaner is shown in U.S. Pat. No. 5,787,546 which has a flexible hose. However the vacuum cleaner has an integral carpet brush which makes the vacuum cleaner with the carpet brush difficult to use on surfaces other than floors and upholstery.

Embodiments of the present invention aim to address the aforementioned problems.

SUMMARY OF THE INVENTION

According to an aspect of the present invention there is a vacuum cleaner comprising: a housing; a motor fan assembly mounted in the housing; a pivotable inlet nozzle in fluid communication with the motor fan assembly; a dirt container coupled to the pivotable inlet nozzle and the housing; wherein the pivotable inlet nozzle is pivotable between a first operable position whereby the pivotable inlet nozzle is in fluid communication with a flexible hose mounted on the housing and a second operable position whereby the pivotable inlet nozzle projects from the housing and is remote from the flexible hose.

This means that the vacuum cleaner has a flexible hose that is readily available for use by the user. Conveniently the user does not have to find a stored accessory to use a flexible hose. At the same time the arrangement allows the user to have the versatility of a handheld vacuum cleaner with a pivotable nozzle.

Preferably the dirt container is pivotable with respect to the housing and pivots together with the pivotable inlet nozzle. This means that the whole of the dirt container moves with the pivotable nozzle. In this way there is a bearing between the housing and the dirt container which limits the likelihood of it becoming clogged or damaged from dirt or debris.

Preferably the pivotable inlet nozzle abuts the housing when the pivotable inlet nozzle is in the first operable position. This provides a compact low volume solution for storing the pivotable nozzle when it is not in use.

Preferably the housing comprises a seal engageable with both the flexible hose and the pivotable inlet nozzle when the pivotable inlet nozzle is in the first operable position. This ensures that the pivotable nozzle is in fluid communication with the flexible hose without loss in negative pressure.

Preferably the housing comprises a recess for receiving the entire flexible hose. This means that the flexible hose has a compact storage position and means that the flexible hose does not get in the user's way when the flexible hose is not in use.

Preferably a first end of the flexible hose is fixed to the housing and a second end of the flexible hose is detachable from the housing. This means that the flexible hose cannot be completely detached from the vacuum cleaner and lost.

Preferably at least a portion of the flexible hose is detachably mounted to the housing and wrappable around the housing for stowing on the housing. This means that a substantial length of flexible hose can be stored on the vacuum cleaner. By wrapping the hose along both sides of the handle, double the length of hose can be stored.

Preferably the flexible hose comprises a second inlet nozzle. Preferably the second inlet nozzle comprises a coupling mechanism for coupling one or more accessories to the second inlet nozzle. This means that the second inlet nozzle can be used with a variety of tools. Preferably the pivotable nozzle comprises a coupling mechanism for coupling one or more accessories to the second inlet nozzle.

Preferably the coupling mechanism is configured to couple to the housing. This means that the second inlet nozzle is securely fastened to the housing when the flexible hose is not in use.

Preferably the housing comprises a blind hole for receiving the second inlet nozzle. Preferably the housing comprises a handle and the flexible hose is mounted in or on the handle. Preferably the pivotable inlet nozzle is mounted in or on the handle when the pivotable inlet nozzle is in the first operable position. Preferably the handle projects away from the dirt container and comprises a closed loop.

Preferably the pivotable inlet nozzle comprises an indexing mechanism for providing a plurality of second operable positions.

Preferably the vacuum cleaner is a handheld vacuum cleaner.

BRIEF DESCRIPTION OF THE DRAWINGS

Various other aspects and further embodiments are also described in the following detailed description and in the attached claims with reference to the accompanying drawings, in which:

DETAILED DESCRIPTION OF INVENTION

Figure 1:
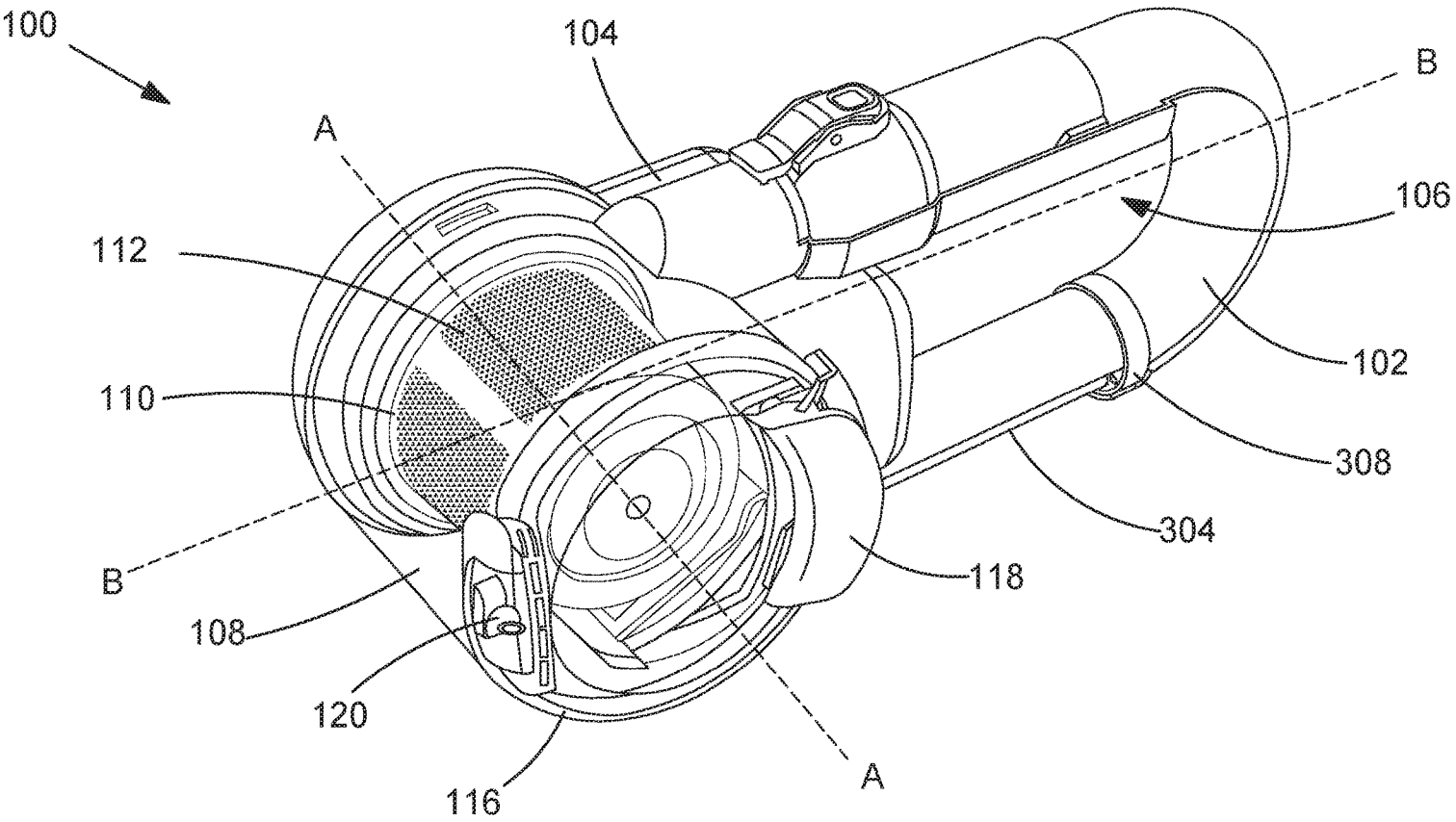
FIG. 1 shows a perspective view of the vacuum cleaner with the pivotable nozzle in a first operable position.

FIG. 1 shows a perspective view of a vacuum cleaner 100. The vacuum cleaner 100 is a handheld vacuum cleaner which is arranged to be held by the user. The vacuum cleaner 100 comprises a handle 102 which allows the user to grip the vacuum cleaner 100 in a plurality of positions.

The handle 102 projects from a housing 104. The handle 102 comprises a "U-shape" where both free ends of the "U" are coupled to the housing 104. The handle 102 forms a closed loop and defines a hole 106. The closed loop arrangement of the handle 102 allows the user to wrap their hands and fingers comfortably around the handle in any orientation. Furthermore the user can pass their hand through the hole 106 and rest the handle 102 on their arm like the strap of a bag. This means that the user can free up both hands when carrying the handheld vacuum cleaner 100.

Figure 2:
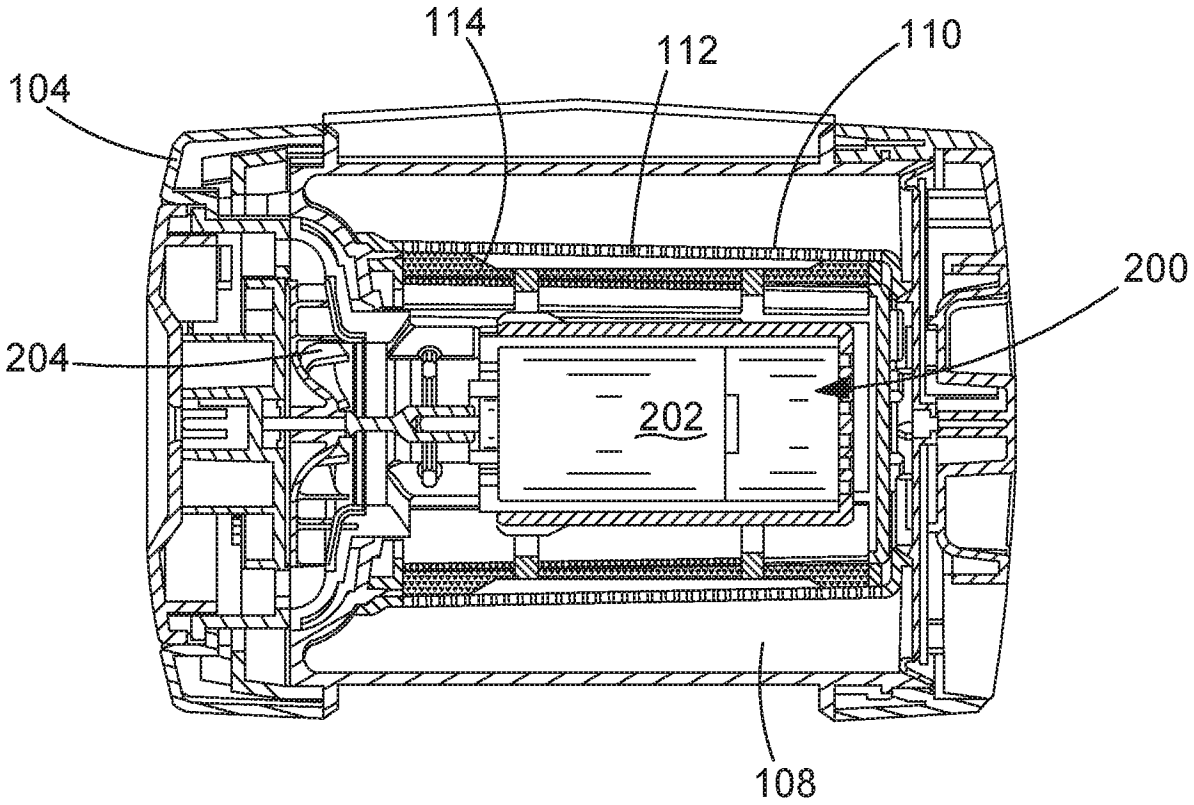
FIG. 2 shows a cross sectional view of the vacuum cleaner along the axis A-A.

The housing 104 houses a motor fan assembly 200 (shown in FIG. 2) for creating a negative pressure for sucking dirt and debris from dirty surfaces. FIG. 2 shows a cross sectional view along the axis A-A as shown in FIG. 1. The motor fan assembly 200 comprises a motor 202 and a fan 204. The housing 104 is formed from a clamshell arrangement with two halves fastened together with screws or any other suitable fastening means. The housing 104 also houses an electrical power source 606 (see FIG. 6) for supplying energy to the motor fan assembly 200. The electrical power source 606 can be a battery 606 (see FIG. 6 or 7) or additionally or alternatively can be a power cord supplying electricity from the mains.

A dirt container 108 is coupled to the housing 104. The dirt container 108 is detachable from the housing 104. In some embodiments the dirt container 108 is mounted to the housing 104 with a bayonet type fitting. The dirt container 108 can be released from the housing 104 with a ¼ turn. In other embodiments any suitable securing means can be used to secure the dirt container 108 to the housing 104. For example clips or a friction fit can be used to detachably secure the dirt container 108 to the housing 104.

A dirt separation means 110 is mounted in the dirt container 108. The dirt separator 110 is arranged to separate dirt and debris entrained in the airflow. The dirt separator 110 comprises a plurality of dirt separation elements. FIG. 1 shows a cup shaped pre-filter 112 which separates large elements from the airflow. The dirt separator 110 also comprises a filter 114 which is arranged to separate smaller dust particles from the airflow. The filter 114 is a pleated filter wherein the pleated filter material is air permeable. In some other embodiments the dirt separator 110 may be any suitable separation means such as a cyclonic separation apparatus, including single stage or multistage cyclonic separation apparatus or a single pleated filter element without the pre-filter. The filter 114 is also cup shaped and nested inside the pre-filter 112. In some embodiments the filter 114 is not nested inside the pre-filter 112 and is located downstream of the filter 114. The pre-filter 112 and the filter 114 are removable from the dirt container 108 for cleaning and replacing.

The motor 202 is mounted inside the dirt separator 110. This makes the vacuum cleaner 100 more compact. In some embodiments (not shown) the motor fan assembly 200 is not nested inside the dirt separator 110 and the motor fan assembly is mounted elsewhere in the housing 104. In this embodiment the motor fan assembly 200 is still in fluid communication with the dirt container 108 and the dirt separator 110 and connected via a conduit (not shown). The air flow path extends from the dirt separator 110 via the motor fan assembly 200 to a clean air exhaust outlet (not shown).

Turning back to FIG. 1, the dirt container 108 comprises a door 116 which is hinged to the dirt container 108. The door 116 is opened with a release mechanism 118 which actuates a latch mechanism (not shown). The door 116 allows for easy emptying of the dirt container without the user having to detach the dirt container 108 from the housing 104.

Figure 3:
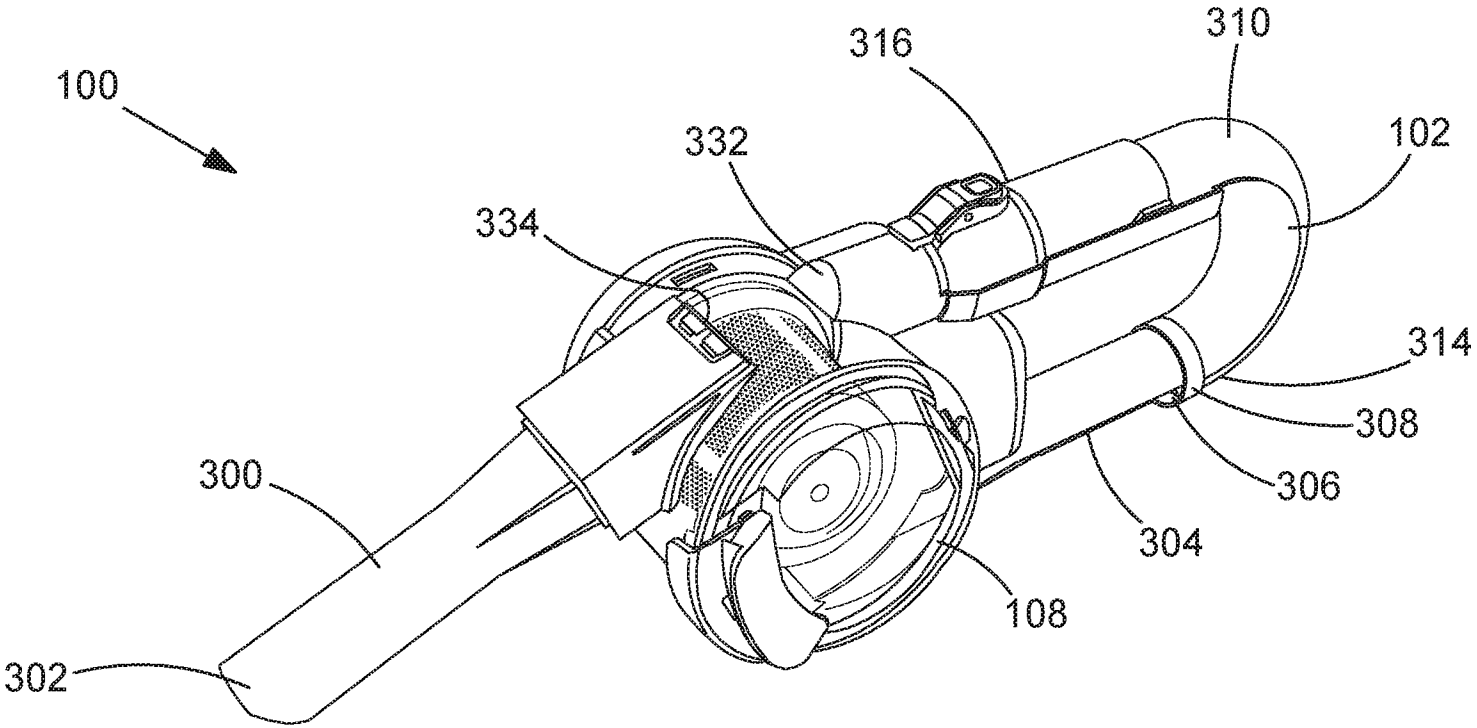
FIG. 3 shows a perspective view of the vacuum cleaner with the pivotable nozzle in a second operable position.

The structure of the vacuum cleaner 100 will be described in further detail in reference to FIG. 3. FIG. 3 shows a perspective view of the vacuum cleaner 100. The vacuum cleaner comprises a nozzle 300 having a dirty air inlet 302. The dirty air inlet 302 is in fluid communication with the dirt container 108. The nozzle 300 is rigid and mechanically coupled to the dirt container 108. The nozzle 300 is coupled to the dirt container 108 with screws or other suitable fastening means. Alternatively the nozzle 300 is integral with the dirt container 108. In some other embodiments the nozzle 300 is not rigid and flexible.

Figure 5:
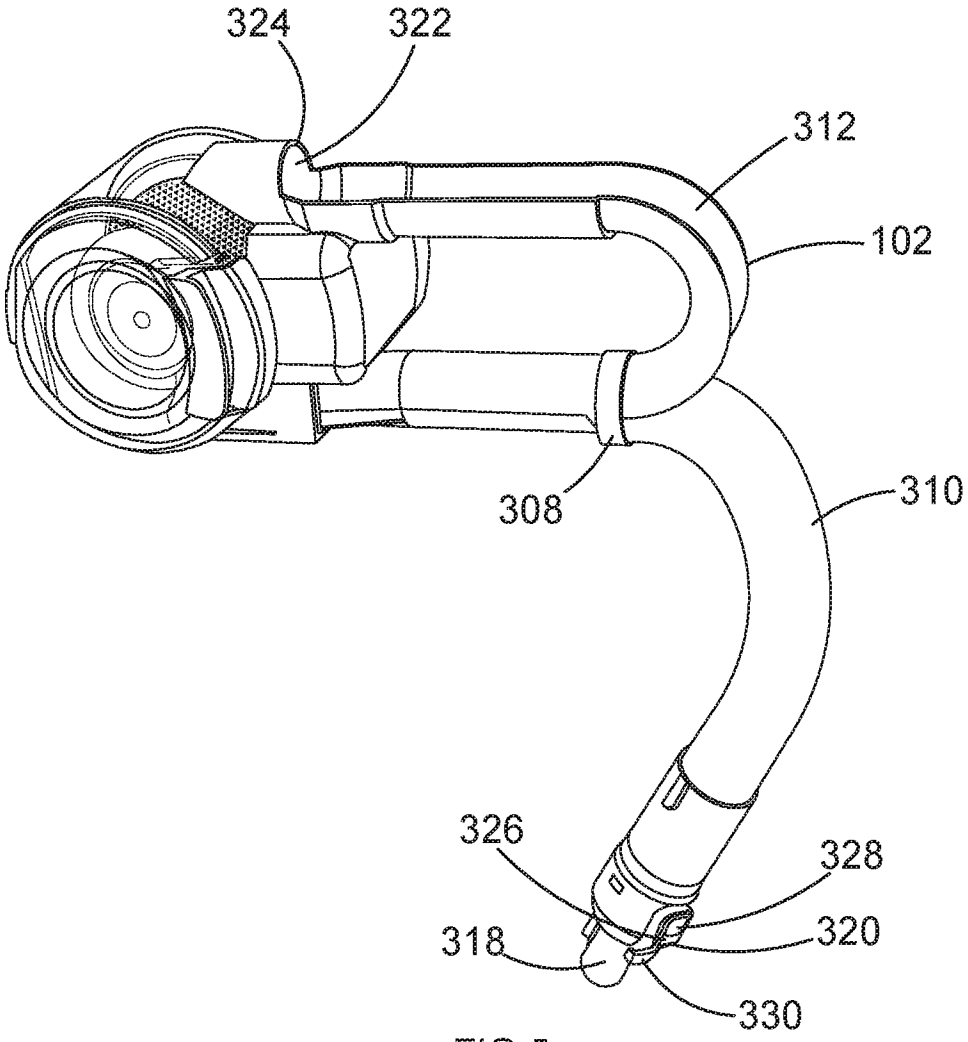
FIG. 5 shows a perspective view of the vacuum cleaner with the pivotable nozzle in the first operable position with a flexible hose detached.

The nozzle 300 is pivotable and moveable between a plurality of operable positions. An operable position of the nozzle is a position whereby the vacuum cleaner can operate and create an air flow path from the dirty air inlet 302 to the dirt container 108. The pivotable nozzle 300 pivots about a pivot axis A-A. The pivot axis A-A is coaxial with the longitudinal axis of the dirt container 108. In some embodiments the pivot axis A-A of the pivotable nozzle 300 is offset from the longitudinal axis of the dirt container 108. The pivotable nozzle 300 is pivotable between a plurality of operable positions. FIGS. 1 and 5 shown the vacuum cleaner 100 with the pivotable nozzle 300 in a first operable position FIG. 3 shows the pivotable nozzle 300 in a second operable position. The different operable positions of the pivotable nozzle 300 will be discussed in more detail later on.

Optionally in some embodiments the dirt container 108 is fixed with respect to the pivotable nozzle 300. This means that the dirt container 108 and the pivotable nozzle 300 move in unison when the pivotable nozzle 300 moves. The dirt container 108 rotates about a rotational axis. In some embodiments the dirt container 108 rotates about the longitudinal axis of the dirt container 108. In this way the dirt container 108 rotates about the same axis A-A as the axis about which the pivotable nozzle 300 pivots. Alternatively the pivotable nozzle 300 is pivotable with respect to both the dirt container 108 and the housing 104. In this way the dirt container 108 does not move when the pivotable nozzle 300 is moved. In the embodiment where the pivotable nozzle 300 is pivotally mounted on the dirt container 108, there is a bearing between the pivotable nozzle 300 and the dirt container 108.

As mentioned above, FIG. 1 shows the pivotable nozzle 300 in a first operable position. In the first operable position the pivotable nozzle 300 abuts the handle 102. The handle 102 comprises a first recess 304 for receiving the pivotable nozzle 300 snugly in the handle 102. The handle 102 comprises a partial open tube with a "U-shaped" cross section. The open portion of the open tube provides the first recess 304. This means that the first recess 304 partially envelops the pivotable nozzle 300 when the pivotable nozzle 300 is in the first operable position.

The dirty air inlet 302 of the pivotable nozzle 300 engages with a seal 306 when the pivotable nozzle 300 is in the first operable position. The seal 306 is a rubber O-ring which forms a friction fit with the outer surface of the pivotable nozzle 300. The seal 306 is mounted in or on a cuff portion 308. The cuff portion 308 is integral with the handle 102 and provides a rigid mounting surface for the seal 306. In other embodiments, the seal 306 can be any suitable means for engaging the outer surface of the pivotable nozzle 300 and creating an air-tight seal there against.

A flexible hose 310 is detachably mounted in the handle 102. The handle 102 comprises a second recess 312 for receiving the flexible hose 310. The second recess 312 can be best see from FIG. 5. FIG. 5 shows a perspective view of the vacuum cleaner 100 with the flexible hose 310 removed from the second recess 312. The pivotable nozzle 300 shown in FIG. 5 is in the first operable position.

Turning back to FIG. 3, the flexible hose 310 is circular in cross section and is seated in the second recess 312 when stowed away. Both FIGS. 1 and 3 show the flexible hose 310 wrapped around the handle 102. The handle 102 comprises a partial open tube with a "U-shaped" cross section. The open portion of the open tube provides the second recess 312. This means that the second recess 312 partially envelops the flexible hose 310 when the flexible hose 310 is wrapped around the handle 102.

The flexible hose 310 is fixed at a first end 314 to the cuff portion 308. A second end 316 of the flexible hose 310 is removable from the second recess 312 of the handle 102. The second end 316 of the flexible hose 310 comprises a second inlet nozzle 318 for receiving dirty air. The second inlet nozzle 318 is received in a blind hole 322 when the flexible hose 310 stowed away. In some embodiments there is a simpler arrangement whereby the second end of the flexible hose 310 does not terminate in an inlet nozzle and only the second end 316 of the flexible hose 310. The flexible hose 310 may also be completely detachable from the handle 102. In the embodiment where the flexible hose 310 is completely detachable, the flexible hose is mountable on the pivotable nozzle 300.

In the embodiments that have the second inlet nozzle 318, the second inlet nozzle 318 is configured to couple to one or more accessories. The accessories are any suitable cleaning tool such as brushes, crevice tools or an extension tube and floor head arrangement. The second inlet nozzle 318 optionally comprises a first coupling mechanism 320 which can best be seen from FIG. 5. FIG. 5 shows a perspective view of the vacuum cleaner with the pivotable nozzle 300 in the first operable position. The first coupling mechanism comprises a biased lever 326. The biased lever comprises a catch end 330 which is moveable between an open position and a locked position. The catch end 330 is actuated by a release button 328. The user presses down on the release button 328 and the catch end 330 raises away from the second inlet nozzle 318 into the open position. When the first coupling mechanism 320 is in the open position accessories can be detached from the second inlet nozzle 318.

The first coupling mechanism 320 comprises a dual use. The first coupling mechanism 320 also engages an outer surface 324 of the blind hole 322 when the second inlet nozzle 318 is received in the blind hole 322. The outer surface 324 comprises a shallow recess in which the catch end 330 engages. This means that the second inlet nozzle 318 is securely fastened to the housing 104 when the flexible hose is wrapped around the handle 102.

In an alternative embodiment, the second inlet nozzle 318 does not have a coupling mechanism. Instead the accessories are fastened to the second inlet nozzle 318 with a friction fit.

The flexible hose 310 is in fluid communication with the cuff portion 308. This means that when the pivotable nozzle 300 is in the first operable position and the pivotable nozzle 300 is engaged with the seal 306 and the cuff portion 308, the pivotable nozzle 300 is in fluid communication with the flexible hose 310. This means that the air flow path is extended through the pivotable nozzle 300 along the flexible hose 310 and to the second inlet nozzle 318 when the pivotable nozzle is in the first operable position.

In other words the flexible hose 310 provides an extension hose for the pivotable nozzle 300. The flexible hose 310 is integral to the vacuum cleaner 100 and this means that the user does not have to store the flexible hose 310 separately. The on-board flexible hose 310 means that the vacuum cleaner has more versatility. In some embodiments the diameter of the second inlet nozzle 318 is smaller than the diameter of the pivotable nozzle 300. This means that the second inlet nozzle 318 can be inserted into smaller and harder to reach places than the pivotable nozzle 300.

During operation the motor fan assembly 200 creates a negative pressure for sucking debris and dirt at the second inlet nozzle 318. In the first operable position, the pivotable nozzle 300 is in fluid communication with the second inlet nozzle 318. Accordingly there is an air flow path from the second inlet nozzle 318 to the dirt container 108 via the pivotable nozzle 300. The seal 306 ensures that the there is no air leaks at the junction between the dirty air inlet 302 and the cuff portion 308.

FIG. 5 shows the flexible hose 310 having been removed from the second recess 312 in the handle 102. The flexible hose 310 in some embodiments has a concertina structure and the flexible hose 310 is extendible. In this way once the flexible hose 310 is removed from the second recess 312, the user pulls on the flexible hose 310 and the concertina walls of the flexible hose 310 expand and the flexible hose 310 extends in length. The flexible hose 310 can be stretched and used to clean high or hard to reach surfaces without raising or moving the vacuum cleaner 100.

Figure 6:
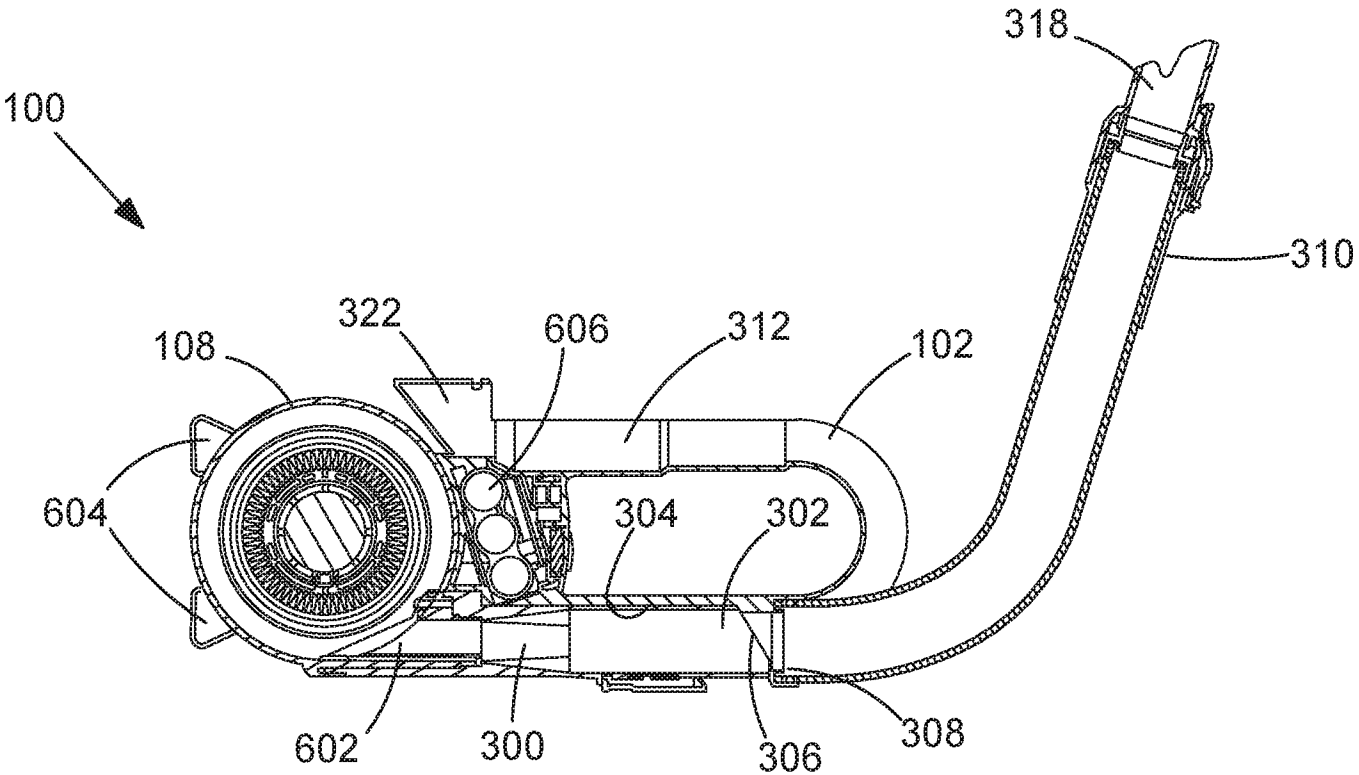
FIG. 6 is a side cross sectional view of the vacuum cleaner along the axis B-B with the pivotable nozzle in the first operable position with a flexible hose detached.

FIG. 6 shows a cross sectional view of the vacuum cleaner 100 along the axis B-B. The pivotable nozzle 300 of the vacuum cleaner 100 in the first operable position. The pivotable nozzle 300 is sealed against the cuff portion 308 by engaging with seal 306. The dirt container 108 comprises a tangential opening 602 for receiving dirty air from the pivotable nozzle 300. The flexible hose 310 is detached from the recess 312 in the handle 102.

In some embodiments the vacuum cleaner 100 may optionally comprise feet 604. The feet 604 allow the vacuum cleaner 100 to be stored vertically wherein the dirt container 108 is adjacent to a horizontal surface and the handle projects upward away from the horizontal surface.

A brief reference will now be made back to FIG. 1. Whilst the arrangement in FIG. 1 shows the pivotable nozzle 300 in the first operable position, the vacuum cleaner 100 is in a stowed position. This is because the second inlet nozzle 318 is seated in the blind hole 322. Accordingly if the motor fan assembly 200 were to be operated in the stowed position, the second inlet nozzle 318 cannot pick up debris or dirt. In some embodiments the blind hole 322 may have a leaky fluid connection with the second inlet nozzle 318. In this way if motor fan assembly were accidentally operated, the second inlet nozzle 318 will still let some air in and the motor 202 is less likely to burn out. In an alternative embodiment there is a sensor such as a microswitch (not shown) that detects when the second inlet nozzle 318 is in the blind hole 322 and the pivotable nozzle 300 is in the first operable position. If the microswitch detects both of these conditions then the switch interrupts the power to the motor fan assembly preventing the motor from actuating.

Turning back to FIG. 3, the second operable position of the pivotable nozzle 300 will be discussed in further detail. FIG. 3 shows the pivotable nozzle 300 projecting forwards away from the handle 102. The pivotable nozzle 300 has rotated from a stowed position shown in FIG. 1 about an angle of approximately 150-165 degrees. This magnitude of angular rotation moves the pivotable nozzle from a rearward position in the handle to a forward position. In the second operable position the pivotable nozzle 300 is not in fluid communication with the second inlet nozzle 318. The pivotable nozzle 300 is arranged to rotate though an angle of approximately 270 degrees. The rotation of the pivotable nozzle 300 is arrested by a stop member 332 abutting against a top surface 334.

Figure 7:
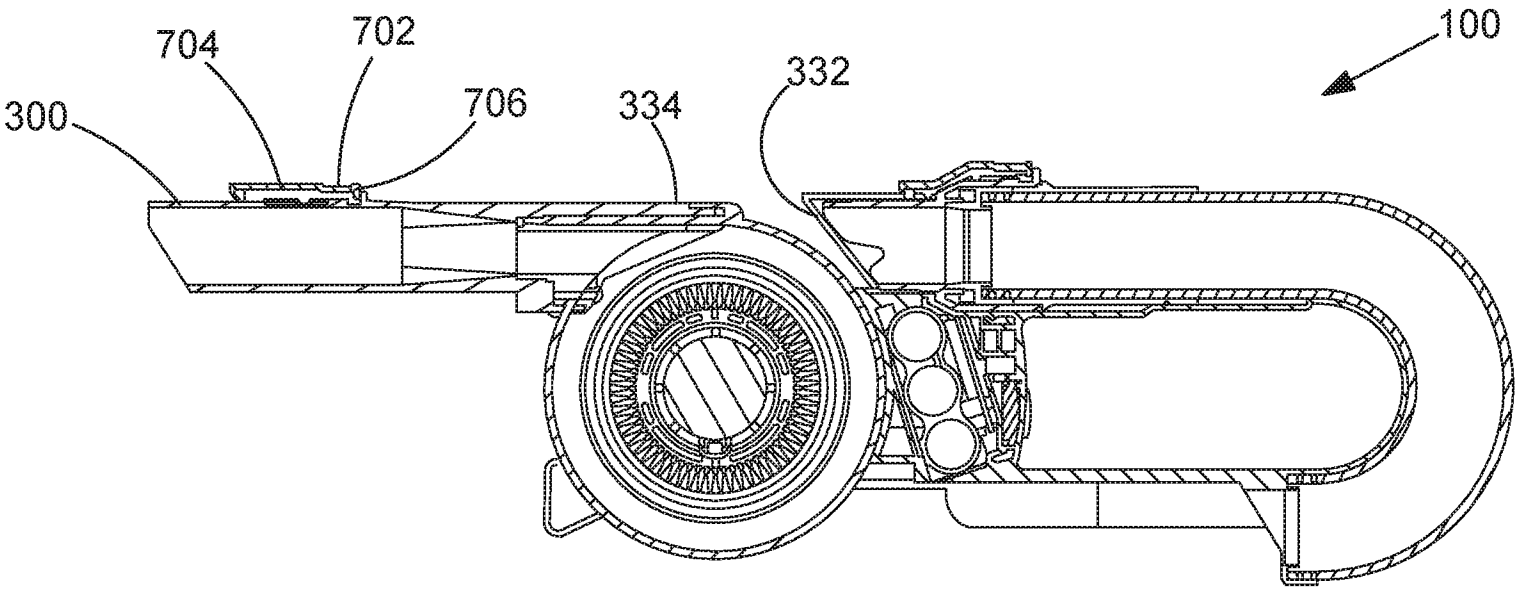
FIG. 7 is a side cross sectional view of the vacuum cleaner along the axis B-B with the pivotable nozzle in the second operable position.

This is also shown in FIG. 7 which shows a cross section of the vacuum cleaner 100 with the pivotable nozzle 300 in the second operable position. The pivotable nozzle 300 in some embodiments may optionally comprise a second coupling mechanism 702. The second coupling mechanism 702 is adapted to receive one or more cleaning accessories and securely attach the cleaning accessories to the pivoting nozzle 300. The cleaning accessories are compatible with both the first and the second coupling mechanisms. In this way a cleaning accessory can be attached to either of the pivoting nozzle 300 via the second coupling mechanism 702 or the second inlet nozzle 318 via the second coupling mechanism 320. The second coupling mechanism 702 comprises a lever mechanism 704 which is actuated by a button 706. In this way the structure and function of the second coupling mechanism 702 is almost identical to the first coupling mechanism 320.

Figure 4:
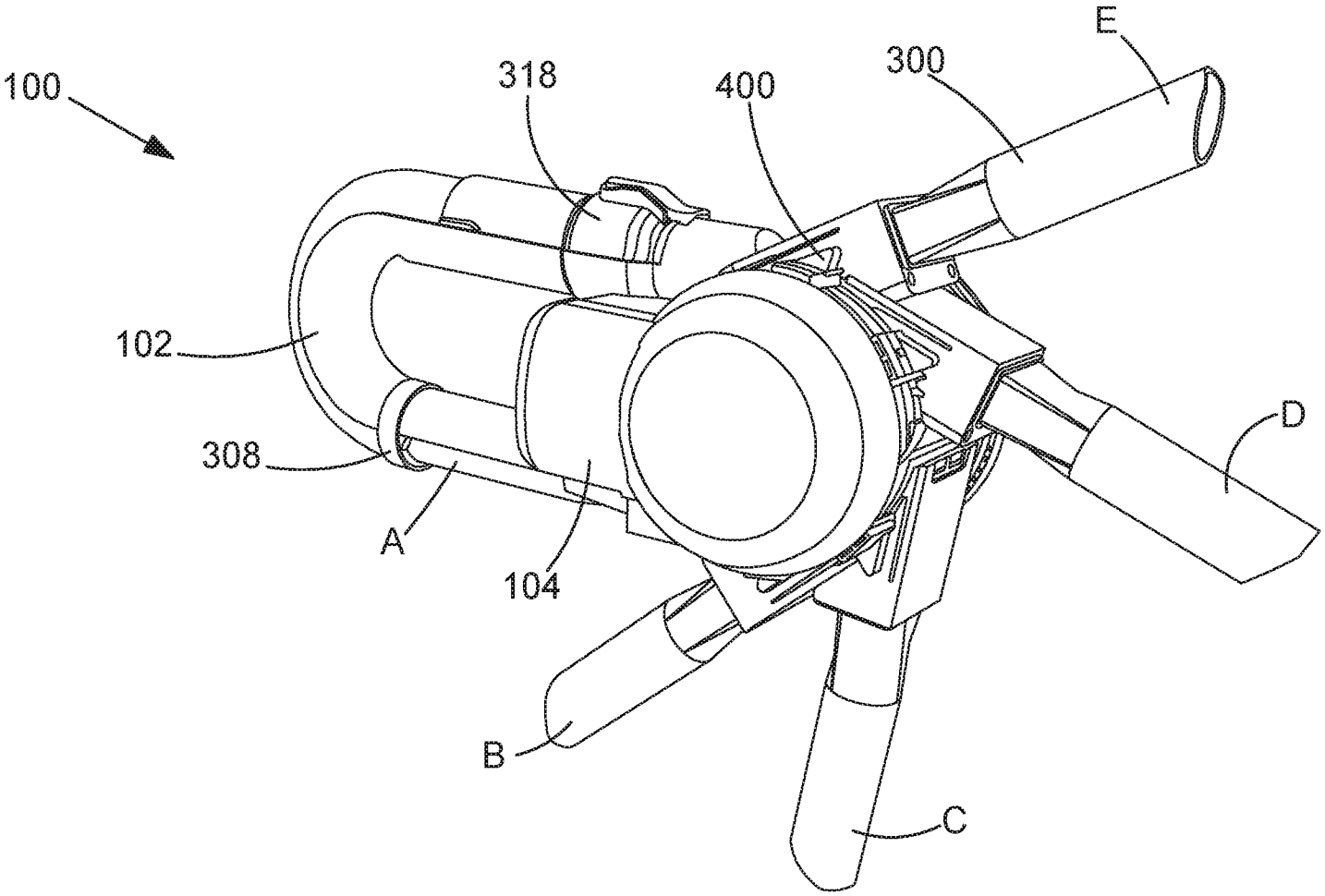
FIG. 4 shows a perspective view of the vacuum cleaner with the pivotable nozzle in a plurality of positions.

The extent of the rotation of the pivotable nozzle 300 is best seen from FIG. 4. FIG. 4 shows a perspective view of the vacuum cleaner 100 with the pivotable nozzle 300 in a plurality of positions (A,B,C,D,E) superimposed on each other.

Position A shows the pivotable nozzle 300 in the first operable position. In this first operation position the pivotable nozzle 300 is in fluid communication with the second inlet nozzle 318.

Positions B, C, D and E all show the pivotable nozzle 300 in a plurality of second operable positions whereby the pivotable nozzle 300 has under gone a different amount of rotational movement with respect to the housing 104 and the handle 102. In positions B, C, D and E the pivotable nozzle 300 is not in fluid communication with the second inlet nozzle 318.

Position 13 shows the pivotable nozzle 300 having rotated about 30 to 40 degrees with respect to the housing 104. Position C shows the pivotable nozzle 300 having rotated about 90 degrees with respect to the housing 104. Position D shows the pivotable nozzle 300 having rotated about 150 to 165 degrees with respect to the housing 104. Position D is the normal position for orientating the pivotable nozzle forwards. Position E shows that the pivotable nozzle 300 having rotated about 270 degrees with respect to the housing 104. Position E is the maximum extent that he pivotable nozzle 300 can be rotated away from the handle 102. The maximum extent of the rotation is determined by the position of the stop member 332 abutting against the top surface 334. The pivotable nozzle may be arranged to rotated to any number of second operable positions. In some embodiments the pivotable nozzle 300 and the dirt container 108 are configured to slidably rotate to any position between the extreme positions (e.g. positions A and E). The dirt container 108 is arranged to provide a frictional force between the dirt container 108 and the housing 104 such that the relative rotational orientation of the pivotable nozzle 300 to the housing is maintained.

In another embodiment there is optionally a rotational locking mechanism 400. The rotational locking mechanism 400 comprises a biased locking member mounted on the dirt container 108. The biased locking member is urged into the dirt container 108 towards the housing 104. The biased locking member is actuated with a locking mechanism release button which moves the biased locking member from a locked position to an unlocked position when pressed. The housing 102 comprises an indexing member with a plurality of indexing recesses for receiving the biased locking member. When the locking member is received in one of the indexing recesses, the dirt container 108 is fixed with respect to the housing and is prevented from rotating with respect to the housing 108. The indexing member is an indexing ring and the indexing recesses are distributed around the ring. Each indexing recess corresponds to an indexed position of the dirt container 108 with respect to the housing 104. For example each of positions A, B, C, D, E would each correspond to an indexed recess on the indexing ring. To release the dirt container 108 and the pivotable nozzle 300, the locking mechanism release button is depressed and the dirt container 108 is rotated with respect to the housing 104. The biased locking member will move into the next indexing recess with an audible click.

In operation the motor fan assembly 200 creates a negative pressure and dirt and debris are sucked in at the dirty air inlet 302. In the second operable position, the air flow path is from the dirty air inlet 302 to the dirt container 108. Air does not flow through the flexible hose 310 when the pivotable nozzle 300 is in the second operable position.

Figure 8:
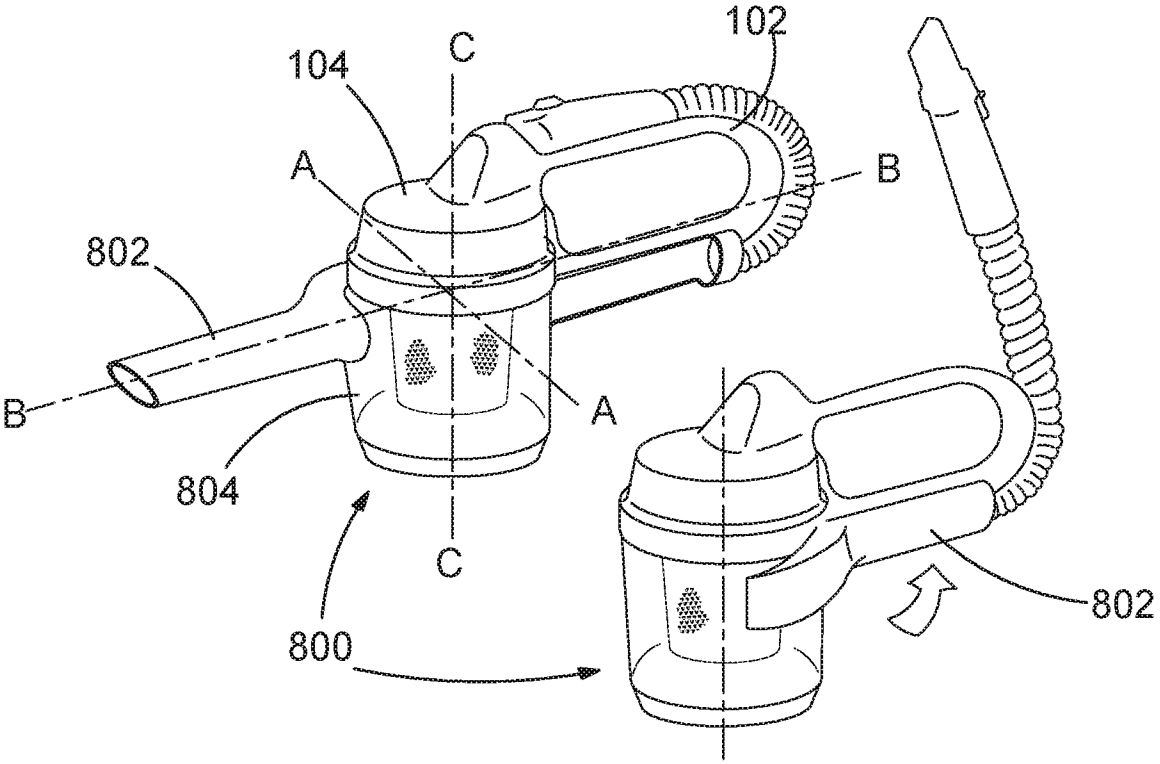
FIG. 8 is a perspective view of another vacuum cleaner with the pivotable nozzle in both the first and second operable positions.

An alternative embodiment of the vacuum cleaner is shown in FIG. 8. FIG. 8 shows a perspective view of the vacuum cleaner with the pivotable nozzle 802 in a first operable position and a second operable position. The vacuum cleaner 800 is substantially the same as the vacuum cleaner 100 described in reference to the previous Figures. However the vacuum cleaner 800 differs in that the dirt container 804 is orientated orthogonally to the position of the dirt container 108 in the previous embodiments. In this way the dirt container 804 has an upright orientation when the vacuum cleaner is held horizontally at the handle 102 by the user.

FIG. 8 shows that the longitudinal and rotational axis of the dirt container 804 is along axis C-C. The longitudinal and rotational axis of the cylindrical dirt container 108 of the previous embodiments is along the axis A-A. The axis A-A, B-B and C-C are orthogonal or substantially orthogonal to each other. The handle 102 is elongate and the handle 102 extends substantially along a longitudinal axis aligned, collinear or parallel with axis B-B.

In can be seen that the handle extends substantially in the plane which contains the axes B-B and C-C. Accordingly the rotational and longitudinal axis of the dirt container 804 lies in the same plane in which the handle extends.

In contrast the embodiments discussed in reference to FIGS. 1 to 7 show that the longitudinal axis and rotational axis of the dirt container 108 is along axis A-A. Axis A-A is transverse to the plane in which the handle 102 extends. This means that the dirt container 108 is on its side and extends horizontally when the vacuum cleaner 100 is horizontal and held by the handle 102 by the user.

FIG. 8 shows that the dirt container 804 and the pivotable nozzle 802 are pivotable with respect to the housing 104 which is the same functionality as the previous embodiments. The pivotable nozzle 802 approaches the handle 102 from the side and seals in the same way as previously discussed.

Figure 9:
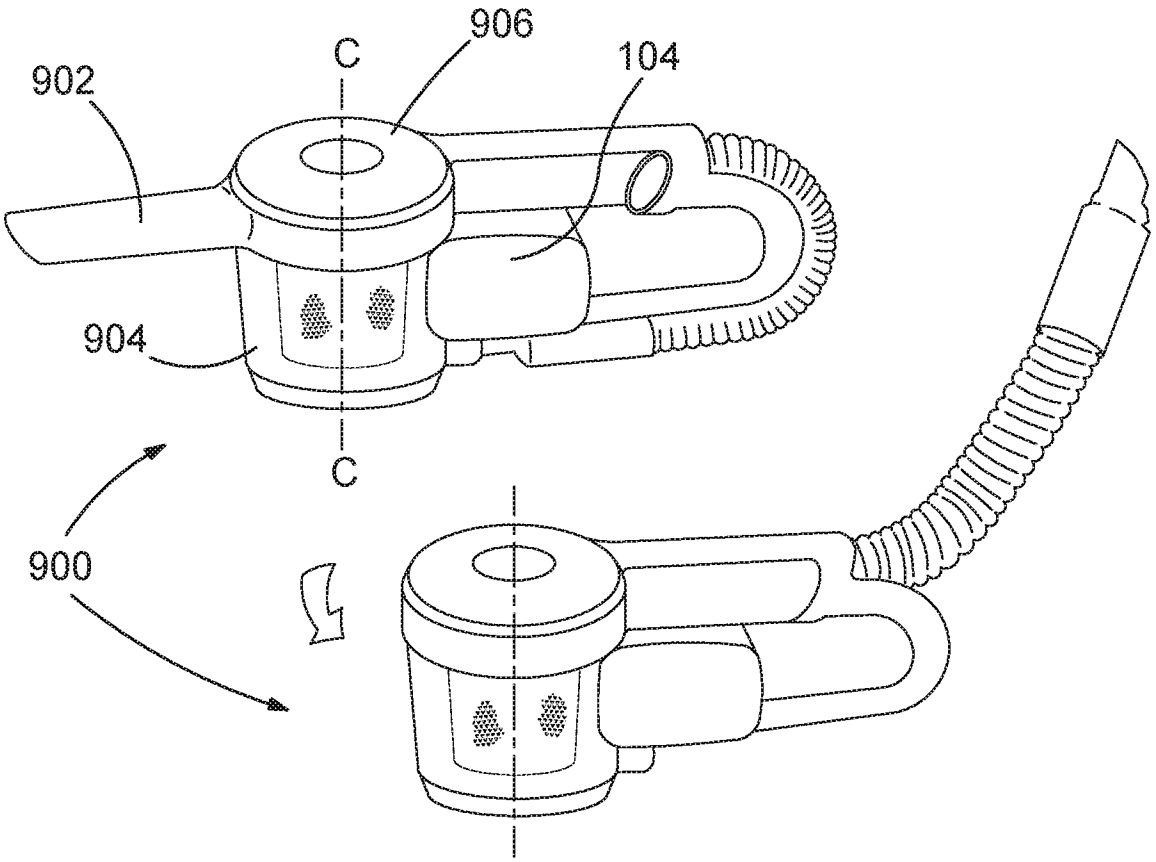
FIG. 9 is a perspective view of another vacuum cleaner with the pivotable nozzle in other the first and second operable positions.

FIG. 9 shows another embodiment of the vacuum cleaner. FIG. 9 shows a perspective view of the vacuum cleaner 900 in the pivotable nozzle 902 in a first operable position and a second operable position. Vacuum cleaner 900 is the same as the vacuum cleaner 800 and the previously discussed embodiments in reference to FIGS. 1 to 7. However vacuum cleaner 900 differs in that the pivotable nozzle 902 is mounted at an end of the dirt container 904. The pivotable nozzle 902 is mounted on an end cap 906 of the dirt container. The end cap 906 seals one end of the dirt container 904. The pivotable nozzle 902 can be integral with the end cap 906 or mounted thereon. The orientation of the dirt container 904 is aligned along axis C-C and is the same as the dirt container 804 discussed in referenced to FIG. 8.

In one embodiment the pivotable nozzle 902 and the dirt container 904 rotates about axis C-C with respect to the housing 104. The dirt container 904 rotates with the same functionality as previously described with reference to the embodiment shown in FIG. 8.

However in another embodiment the pivotable nozzle 902 and the end cap 906 pivot with respect to the dirt container 904 and the housing 104. In this way the dirt container 904 is fixed with respect to the housing 104 when the pivotable nozzle 902 pivots with respect to the housing 104.

In another embodiment two or more embodiments are combined. Features of one embodiment can be combined with features of other embodiments.

Embodiments of the present invention have been discussed with particular reference to the examples illustrated. However it will be appreciated that variations and modifications may be made to the examples described within the scope of the invention.

The invention claimed is:

1. A vacuum cleaner comprising:

a housing;

a motor fan assembly mounted in the housing;

a pivotable inlet nozzle in fluid communication with the motor fan assembly;

a dirt container coupled to the pivotable inlet nozzle and the housing;

wherein the pivotable inlet nozzle is pivotable between a first operable position whereby the pivotable inlet nozzle is in fluid communication with a flexible hose mounted on the housing and a second operable position whereby the pivotable inlet nozzle projects from the housing and is remote from the flexible hose.

2. A vacuum cleaner according to claim 1 wherein the dirt container is pivotable with respect to the housing and pivots together with the pivotable inlet nozzle.

3. A vacuum cleaner according to claim 1 wherein the pivotable inlet nozzle abuts the housing when the pivotable inlet nozzle is in the first operable position.

4. A vacuum cleaner according to claim 1 wherein the housing comprises a seal engageable with both the flexible hose and the pivotable inlet nozzle when the pivotable inlet nozzle is in the first operable position.

5. A vacuum cleaner according to claim 1 wherein the housing comprises a recess for receiving the entire flexible hose.

6. A vacuum cleaner according to claim 1 wherein a first end of the flexible hose is fixed to the housing and a second end of the flexible hose is detachable from the housing.

7. A vacuum cleaner according to claim 1 wherein at least a portion of the flexible hose is detachably mounted to the housing and wrappable around the housing for stowing on the housing.

8. A vacuum cleaner according to claim 1 wherein the flexible hose comprises a second inlet nozzle.

9. A vacuum cleaner according to claim 8 wherein the second inlet nozzle comprises a coupling mechanism for coupling one or more accessories to the second inlet nozzle.

10. A vacuum cleaner according to claim 9 wherein the coupling mechanism is configured to couple to the housing.

11. A vacuum cleaner according to claim 8 wherein the housing comprises a blind hole for receiving the second inlet nozzle.

12. A vacuum cleaner according to claim 1 wherein the housing comprises a handle and the flexible hose is mounted in or on the handle.

13. A vacuum cleaner according to claim 12 wherein the pivotable inlet nozzle is mounted in or on the handle when the pivotable inlet nozzle is in the first operable position.

14. A vacuum cleaner according to claim 12 wherein the handle projects away from the dirt container and comprises a closed loop.

15. A vacuum cleaner according to claim 1 wherein the pivotable inlet nozzle comprises an indexing mechanism for providing a plurality of second operable positions.

16. A vacuum cleaner according to claim 1 wherein the vacuum cleaner is a handheld vacuum cleaner.

* * * * *